United States Patent [19]

Washer et al.

[11] 4,345,992

[45] Aug. 24, 1982

[54] CATALYTIC CRACKING PROCESS

[75] Inventors: Stone P. Washer; Joe Van Pool, both of Bartlesville, Okla.

[73] Assignee: Phillips Petroleum Company, Bartlesville, Okla.

[21] Appl. No.: 200,646

[22] Filed: Oct. 27, 1980

[51] Int. Cl.[3] ..... C10G 47/00; C10G 47/24; B01J 37/12; B01J 37/18

[52] U.S. Cl. ..... 208/120; 208/113; 208/153; 208/164; 252/417; 252/418

[58] Field of Search ..... 208/120, 164, 113, 153; 252/418; 422/223

[56] References Cited

U.S. PATENT DOCUMENTS

| | | | |
|---|---|---|---|
| 2,575,258 | 11/1951 | Corneil et al. | 208/120 |
| 2,684,927 | 7/1954 | Bergstrom | 208/174 |
| 2,694,036 | 11/1954 | Myers | 208/174 |
| 2,741,603 | 4/1956 | Fahnestock | 252/418 |
| 2,880,170 | 3/1959 | Savoca et al. | 208/173 |
| 2,922,757 | 1/1960 | Oliver et al. | 422/223 |
| 3,030,300 | 4/1962 | Flanders et al. | 208/120 |
| 3,247,100 | 4/1966 | Haddad | 208/113 |
| 3,652,231 | 3/1972 | Greenwood et al. | 252/418 |

*Primary Examiner*—Delbert E. Gantz
*Assistant Examiner*—Olik Chaudhuri

[57] ABSTRACT

In a cracking process wherein used catalyst is regenerated, contacted with reducing gas to counter effects of contaminating metals, and recycled to the cracking zone, the improvement comprising using a gas seal to assure that a major portion of the unconsumed reducing gas is also passed into the cracking zone.

9 Claims, 1 Drawing Figure

CATALYTIC CRACKING PROCESS

Figure 1:
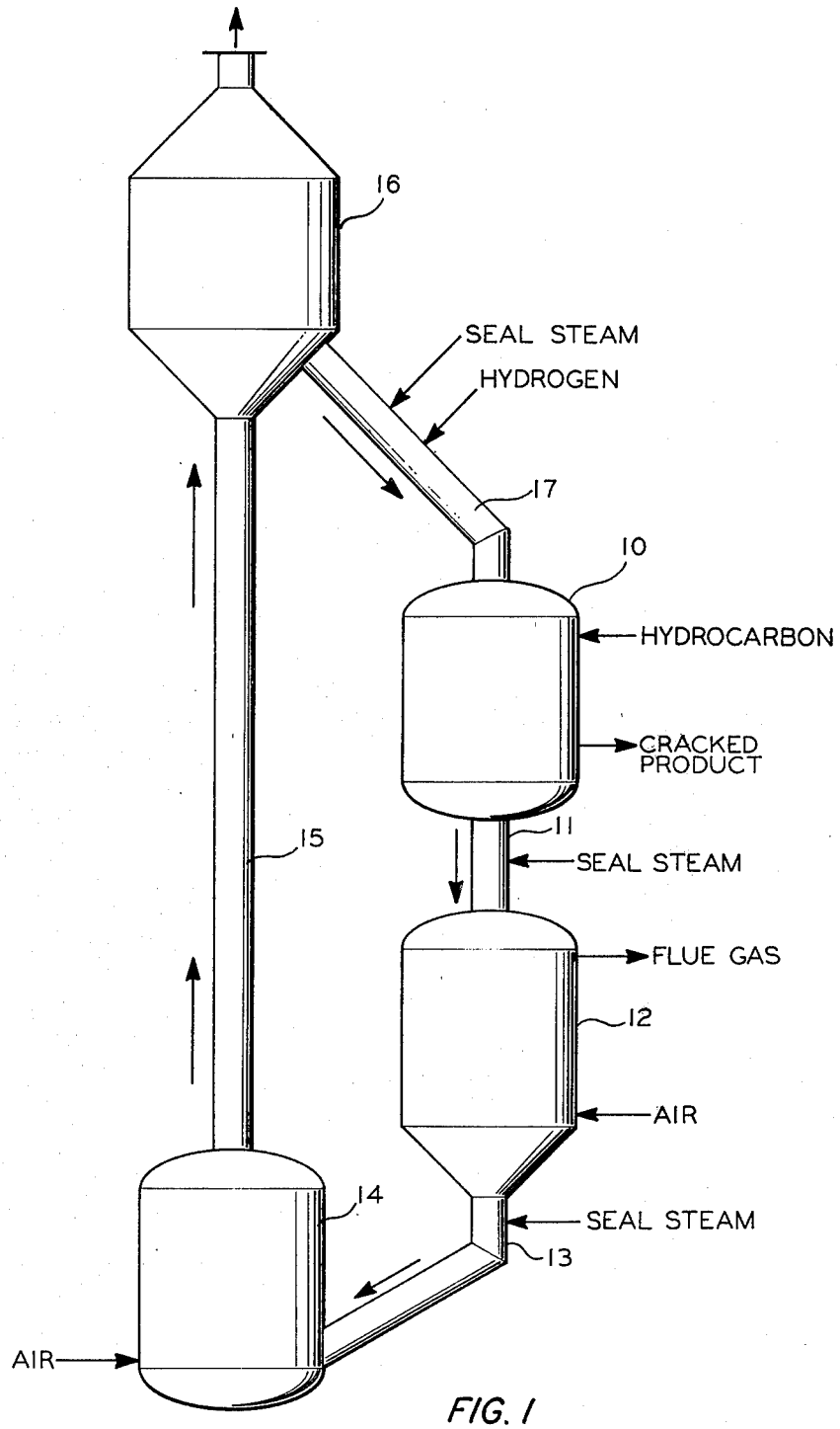

The present invention relates to the catalytic cracking of hydrocarbons, for example petroleum fractions.

It is well known to employ catalysts for the conversion of relatively high molecular weight hydrocarbons, such as naphtha, gas oil, petroleum residuum and the like, to relatively low molecular weight cracked products including hydrocarbons such as cracked gasoline, light olefins, and the like. In many commercial operations, it is common to routinely withdraw equilibrium catalyst and add fresh or regenerated catalyst to maintain catalyst activity. Factors contributing to the deactivation of the catalysts include coke formation and the formation of deposits of contaminating metals such as nickel, vanadium, iron, and copper. These metals can come from erosion of the metallic equipment and/or from corresponding metals and metal compounds contained in the hydrocarbon feed.

These contaminating metals generally tend to act as dehydrogenation catalysts, and therefore as they accumulate they begin to alter the product distribution of the cracking process so that generally more coke and hydrogen are produced which, of course, results in a reduction in yield of the desired products.

Various techniques have been proposed for countering the effects of such contaminating metals. U.S. Pat. No. 2,575,258 discloses one such process in which equilibrium silica-alumina catalyst is first regenerated by air for combustion of coke which was deposited on the catalyst during the cracking, and the regenerated catalyst is subjected to reduction with a reducing gas to counter the effects of contaminating metals.

An object of the present invention is to provide an improved process for countering the adverse effects of contaminating metals in a process wherein catalyst is continually withdrawn from the cracking zone, regenerated, and recycled back to the cracking zone. The term "continually" is used herein to include repetitive intermittent steps as well as continuous processes.

Other aspects, objects, and advantages of the present invention will become apparent to those skilled in the art after having the benefit of this disclosure.

In accordance with the present invention, there is provided a process for the catalytic cracking of hydrocarbons wherein said hydrocarbons are contacted with particulate cracking catalyst under cracking conditions in a cracking zone, portions of said cracking catalyst are continually transferred to a regeneration zone or kiln where carbonaceous materials thereon are consumed by combustion, the thus regenerated catalyst is continually transferred to a reduction zone wherein said catalyst is exposed to a reducing gas under conditions so that the adverse effects of contaminating metals thereon are at least reduced, wherein a gaseous seal is employed upstream of the hydrogenation zone to assure that the major portion of the unconsumed reducing gas passes into the cracking zone.

The present invention is considered equally applicable to either the moving bed process, commonly known as the TCC or Thermofor Catalytic Cracking process, or the FCC or Fluid Catalytic Cracking processes which are described in U.S. Pat. No. 2,575,258, the disclosure of which is incorporated herein by reference.

FIG. 1 provides an illustration of the present invention as applied to a moving bed or "Thermofor" type cracking unit.

The feed for the TCC process can include any of the conventional feeds. The present process is particularly useful in cracking virgin gas oils which contain concentrations of contaminating metals of about 1 to 5 ppm by weight of contaminating metals, measured as the metal.

The catalysts employed can include any conventionally employed cracking catalysts such as oxides of silicon and aluminum, silicon and zirconium, silicon and titanium, silicon and magnesium, and certain specially activated natural clays. The present invention is applicable to processes using crystalline aluminosilicate catalysts (i.e. zeolites) as well as amorphous aluminosilicates. While it has been noted that the contaminating metals produce somewhat less adverse effects on the zeolite type cracking catalysts, it has also been observed that the adverse effects of the metals on amorphous catalysts is more readily reduced by repeated regenerations than for the zeolite type catalyst. Coworkers of the present inventors have recently demonstrated that reduction can be beneficial in countering the adverse effects of contaminating metals on zeolite containing cracking catalysts as well as amorphous type cracking catalysts.

The catalytic cracking can be carried out under any conditions suitable for cracking the hydrocarbon feed. Typically that involves contacting the catalyst with the feed at temperatures in the range of about 800° F. to 1200° F. Pressures can generally range from subatmospheric to about 3000 psig. Typically the weight ratio of catalyst to hydrocarbon feed is in the range of about 3:1 to 30:1.

In the regeneration step carbonaceous materials on the used catalyst are removed by combustion in an oxygen-containing atmosphere at a temperature in the range of about 950° F. to about 1500° F.

In the reducing step the regenerated catalyst is contacted with the reducing gas. Generally any suitable reducing gas can be employed. Examples include carbon monoxide, hydrogen, propane, methane, ethane, and mixtures thereof. It is currently preferred to employ a reducing gas containing hydrogen. The volume of reducing gas employed in contacting the catalyst and the temperatures and pressures maintained should be adjusted so as to convert substantially the contaminating metal oxides present in the catalyst to compounds having substantially less or no detrimental effect on the activity of the catalyst. Depending upon the nature of the contaminating materials and upon the amount and kind of reducing atmosphere employed, the temperature at which the contaminated catalyst is contacted with the reducing atmosphere can vary, but generally will be within the range of 850° F. to about 1100° F. Inasmuch as the pressure maintained in the several known catalyst cracking processes may differ and since the pressure maintained will have an influence on the reactions which take place in the reducing atmosphere, the temperature and throughput must be correlated in each instance with the pressure maintained in the particular unit. It should be remembered that the volume of reducing gas required will also depend upon the nature and amount of the contaminating oxides. When relatively small quantities of contaminating oxides are present in the catalyst, very small volumes of reducing gas and/or short contact times may be employed with satisfactory results, while when relatively large quantities of contaminating oxides are present in the catalyst larger volumes of reducing gas and/or long contact times will be required. Typically the amount of hydrogen injected will be in the range of about 5 to about 20 standard cubic feet per pound of contaminating metals on the catalyst. Contact times will generally be in the range of about 5 minutes to 2 hours.

A gaseous seal is provided upstream of the point of introduction of the reducing gas to assure that the major portion of the unconsumed reducing gas passes to the cracking zone. Preferably substantially all of the unconsumed reducing gas is passed to the cracking zone. If too much hydrogen is allowed to flow back upstream, there is a potential for explosions.

Techniques of providing such gaseous seals are well known in the art. Typical sealing gases include steam, carbon dioxide, or other gases compatible with the regeneration, reduction, and cracking reactions. Steam is presently preferred.

The invention will now be described in regard to a specific application in a moving bed catalytic cracking process as illustrated in FIG. 1.

The moving bed or "Thermofor" system comprises a cracking reactor 10, wherein cracking catalyst in the form of solid particles, such as pelleted cylinders having dimensions of about 3/16×3/16 inches, flows downwardly as a moving generally nonturbulent contiguous bed. Catalyst from the lower portion of the bed is transferred by conduit 11 to a regenerator vessel or kiln 12 in which the coke deposited on the catalyst is substantially removed by combustion.

Catalyst particles from the regenerator flow via conduit 13 to a lift pot 14 from where they are lifted vertically upwardly through conduit 15 to vessel 16 which comprises a disengaging zone. The disengaged lifting gas is removed from the top of vessel 16. Catalyst particles disengaged from the lifting gas settle in vessel 16 and flow to the reactor 10 via downcomer conduit 17.

In downcomer 17 a reducing gas, such as hydrogen, is introduced. Seal steam is injected between the disengaging vessel 16 and the hydrogen injection locus. The seal steam assures that substantially all of the reducing gas is passed into the cracking reactor 10 along with the catalyst. As the catalyst passes downwardly through conduit 17 the reducing gas reduces at least some of the contaminating metal oxides so that the catalyst containing the metals in the reduced state will produce less coke and less hydrogen.

The directing of the reducing gas to the cracking zone also tends to shift the cracking equilibrium toward less hydrogen production from the hydrocarbon feed.

Typical conditions and results for such a moving bed process are as follows:

| | |
|---|---|
| Hydrocarbon Feed (Virgin Gas Oil): | |
| Barrels/hour | 330 |
| Entry Temperature, °F. | 820 |
| Entry Pressure | 18 |
| API at 60° F. | 27.5 |
| Boiling Range, °F. | 600–1100+ |
| Contaminating metals, ppm by weight (as Fe, V, Ni) | 4 |
| Reactor 10 Conditions (Outlet): | |
| Catalyst Circulation, Tons/hour | 300 (+2.5 tons of coke) |
| Temperature, °F. | 910 |
| Pressure, psig | 9 |
| Residence Time, minutes | 1.7 |
| Catalyst to Oil Weight Ratio | 4.1:1 |
| Cracked Products: | |
| Residue Gas, SCF/hour | 230,000 |
| Olefins, Barrels/hour | 80 |
| Cracked Gasoline, Barrels/hour | 210 |
| Cracked Distillates, Barrels/hour | 30 |
| Bottoms, Barrels/hour | 15 |
| Catalyst in Conduit 11: | |
| Tons/hour | 302.5 |
| Temperature, °F. | 910 |
| Coke, Wt. % | 0.83 |
| Regeneration Air: | |
| SCF/hour | 18,500 |
| Temperature, °F. | Ambient |
| Pressure, psig | 2 |
| Kiln Conditions: | |
| Catalyst Circulation, Tons/hour (absent coke) | 300 |
| Temperature, °F. (above cooling coil) | 1175 |
| Pressure, psig | 0.5 |
| Catalyst in Conduit 13: | |
| Tons/hour | 300 (+0.15 tons coke) |
| Temperature, °F. | 1050 |
| Coke, Wt. % | 0.05 |
| Lift Air: | |
| SCF/minute | 8500 |
| Temperature, °F. | 750 |
| Pressure, psig | 4.5 |
| Catalyst in Conduit 17: | |
| Tons/hour | 300 (+0.15 tons coke) |
| Temperature, °F. | 1050 |
| Seal Stream in 17: | |
| Pounds/hour | 1250 |
| Temperature, °F. | 366 |
| Pressure, psig | 150 |
| Hydrogen in 17: | |
| SCF/hour | 1500 |
| Temperature, °F. | Ambient |
| Pressure, psig | 150 |

Obviously, many modifications and variations of the invention heretofore described can be made without departing from the spirit and scope thereof.

What is claimed is:

1. In a process for the catalytic cracking of hydrocarbons wherein said hydrocarbons are contacted with particulate cracking catalyst under cracking conditions in a cracking zone, portions of said cracking catalyst are continually transferred to a regeneration zone where carbonaceous materials thereon are consumed by combustion, the thus regenerated catalyst is continually transferred to a reduction zone wherein said catalyst is exposed to a reducing gas under conditions so that the adverse effects of contaminating metals thereon are at least reduced, and the thus reduced catalyst is continually transferred to the cracking zone, the improvement comprising using a gaseous seal upstream of the reducing zone to assure that the major portion of the unconsumed reducing gas passes into the cracking zone.

2. A process according to claim 1 wherein said catalytic cracking catalyst comprises silica-alumina.

3. A process according to claim 2 wherein said catalytic cracking catalyst comprises zeolitic silica-alumina.

4. A process according to claim 3 wherein said reducing gas comprises hydrogen.

5. A process according to claim 4 wherein gaseous seal is provided by steam.

6. A process according to claim 5 wherein said contaminating metals comprise nickel, vanadium, or iron.

7. A process according to claim 6 wherein said process comprises a moving bed cracking process wherein used catalyst is transferred to a regenerator, regenerated catalyst is transferred to a lift pot and then upwardly lifted in a lift leg to a disengaging vessel, and said regenerated catalyst is reduced with hydrogen that is introduced into the conduit which transfers catalyst from the disengaging vessel to the cracking zone.

8. A process according to claim 7 wherein said seal stream is introduced into the conduit which transfers the catalyst from the disengaging vessel to the cracking zone.

9. A process according to claim 8 wherein substantially all of the unconsumed hydrogen is passed to the cracking zone.

* * * * *